US007142181B2

(12) United States Patent
Wang et al.

(10) Patent No.: US 7,142,181 B2
(45) Date of Patent: Nov. 28, 2006

(54) CIRCUIT BOARD FOR LARGE SCREEN LED MATRIX ARRAY DISPLAY

(75) Inventors: Bily Wang, Hsin-Chu (TW); Jonnie Chuang, Taipei (TW); John Lin, Chia-E (TW)

(73) Assignee: Harvatek Corporation, Hsinchu (TW)

( * ) Notice: Subject to any disclaimer, the term of this patent is extended or adjusted under 35 U.S.C. 154(b) by 559 days.

(21) Appl. No.: 10/685,892

(22) Filed: Oct. 16, 2003

(65) Prior Publication Data

US 2005/0083275 A1 Apr. 21, 2005

(51) Int. Cl.
*G09G 5/00* (2006.01)
*G09G 3/32* (2006.01)

(52) U.S. Cl. ..... 345/82; 345/905; 361/681; 248/917

(58) Field of Classification Search ..... 345/204–206, 345/82–83, 903, 905; 40/605; 361/681; 248/917–923
See application file for complete search history.

(56) References Cited

U.S. PATENT DOCUMENTS

| | | | | |
|---|---|---|---|---|
| 3,866,364 | A * | 2/1975 | Pollard | 52/36.5 |
| 5,600,910 | A * | 2/1997 | Blackburn | 40/605 |
| 5,971,174 | A * | 10/1999 | Strock | 211/186 |
| 5,995,179 | A * | 11/1999 | Tamura et al. | 349/58 |
| 6,054,968 | A * | 4/2000 | De Matteo | 312/7.2 |
| 6,474,901 | B1 * | 11/2002 | Thurston | 403/381 |
| 6,677,918 | B1 * | 1/2004 | Yuhara et al. | 345/1.3 |
| 6,741,222 | B1 * | 5/2004 | Tucker | 345/1.1 |
| 2004/0123501 | A1 * | 7/2004 | Safavi et al. | 40/452 |

* cited by examiner

*Primary Examiner*—Lun-Yi Lao
(74) *Attorney, Agent, or Firm*—Rosenberg, Klein & Lee

(57) ABSTRACT

Multiple LED matrix array circuit boards are pieced together a form a display panel. L-shape brackets are mounted on the bottom sides of the circuit boards and aligned with the butting edges of the circuit boards. The vertical butting walls are pressed together by clamps. A set screw is inserted in one jaw of the clamp to tighten the pressure between butting edges of the circuit boards. Another set screw is inserted on top of the clamp to align the adjacent boards vertically.

2 Claims, 5 Drawing Sheets

CIRCUIT BOARD FOR LARGE SCREEN LED MATRIX ARRAY DISPLAY

BACKGROUND OF THE INVENTION

1. Field of the Invention

This invention relates to light emitting diode (LED) display panel, particularly to the printed circuit board for large screen LED display panels.

2. Brief Description of Related Art

Large screen LED display requires more than two LED matrix array circuit boards pieced together. FIG. 1 shows a bottom view of a prior art LED display panel having a more than two circuit boards, such as circuit boards 101, 102, 103, placed side by side with each other. The LED matrix array mounted at the front of the circuit board is not shown. The different circuit boards are held together with links 14. These links are held in place with screws 13 anchored in the fixed nuts 11. Due to manufacturing tolerances in sawing the different circuit boards and in the placement of the nuts 14 on the circuit boards, it is difficult to achieve a seamless interface without any crevice in butting the different circuit boards together. As a result, the matrix arrays on different circuit board may be misaligned and dangling with respect to each other.

SUMMARY OF THE INVENTION

An object of this invention is to intimately butting the different LED circuit board. Another object of this invention is to increase the rigidity of the large screen LED display.

These objects are achieved by mounting L-shaped brackets between the butting edges of adjacent circuit boards. These brackets are then pressed together by clamps at the butting edges, and further tightened with set screws at a jaw and on top of the clamp.

DETAILED DESCRIPTION OF THE INVENTION

Figure 1:
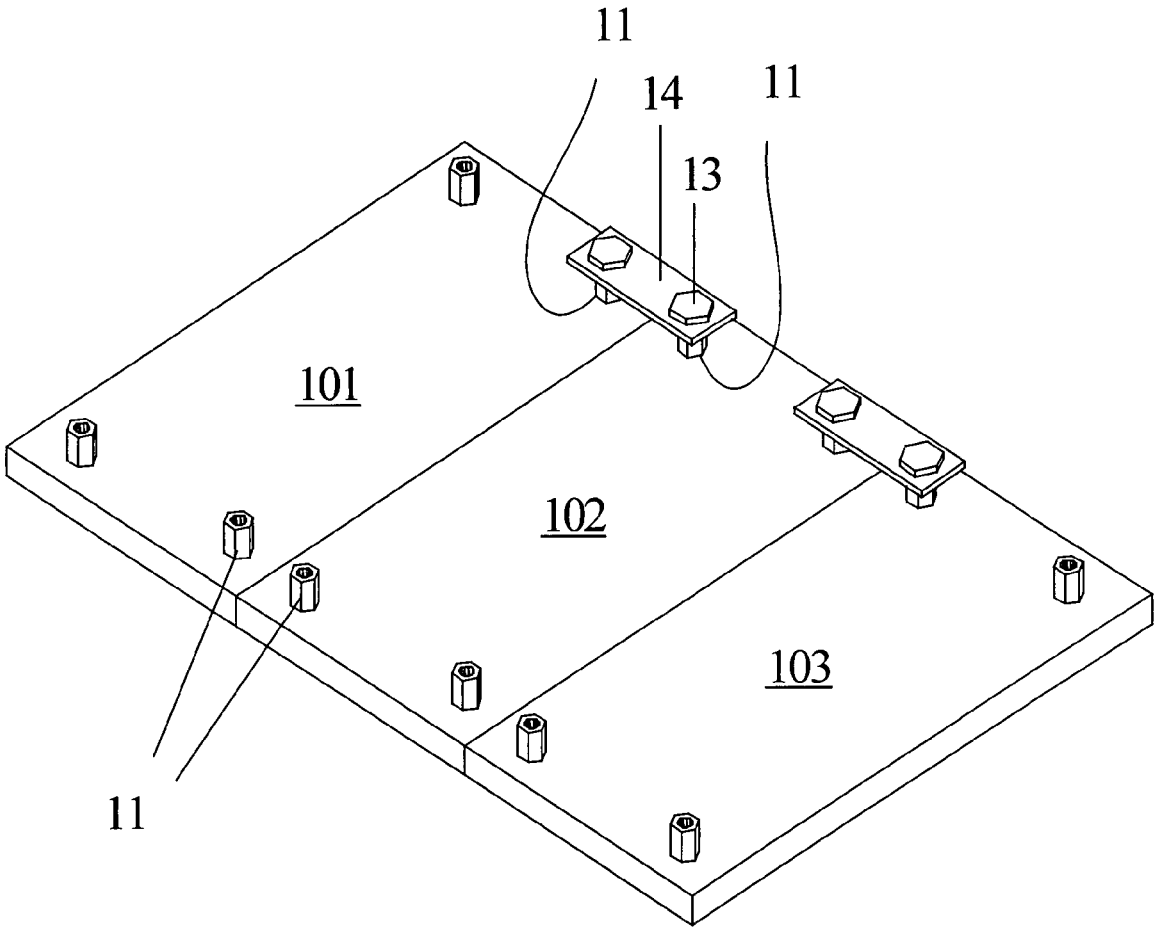
Fig. 1 Prior Art
FIG. 1 shows the backside of a prior art three LED matrix array circuit boards pieced together by screws and nuts.
Figure 2:
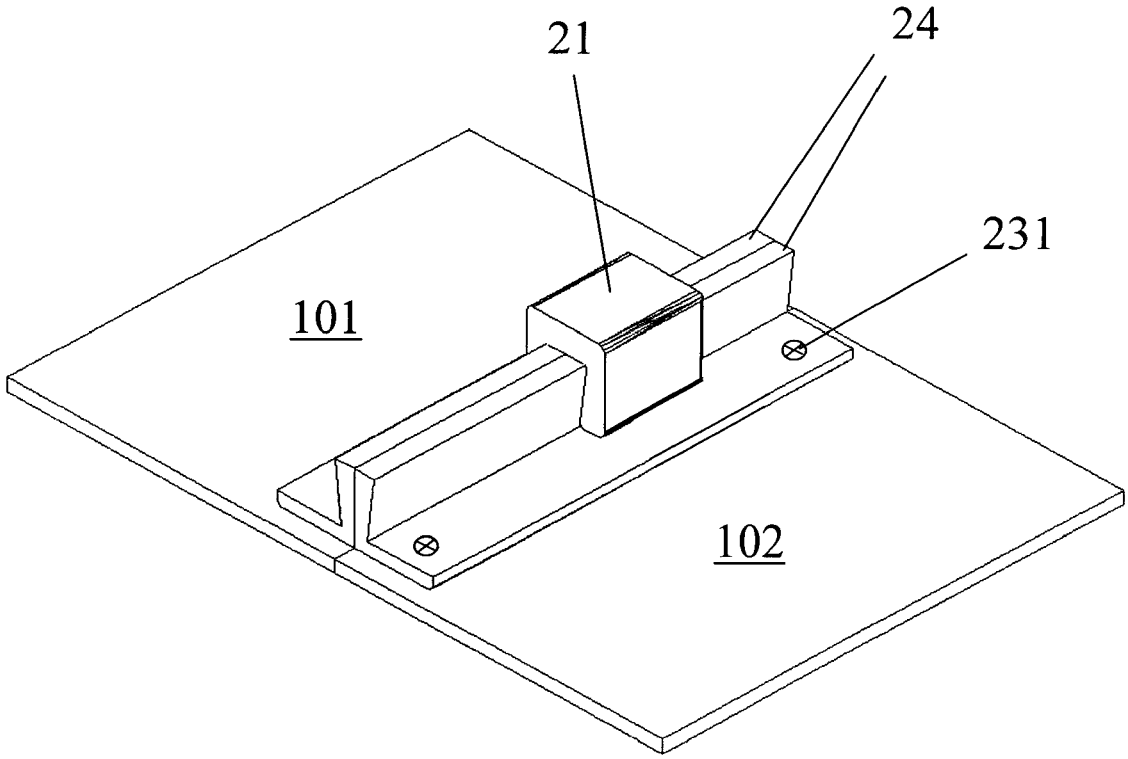
FIG. 2 shows the backside of two LED matrix array circuit boards pieced together by brackets based on the present invention.

FIG. 2 shows the basic structure of the present invention. Two L-shaped brackets 24 are mounted on the bottom sides of two butting edges of two circuit boards 101, 102, to which matrix LED array is attached on the top side of each circuit board. The horizontal faces of the brackets 24 are attached to the circuit boards, 101, 102 by means of screws 231. The vertical walls of the brackets are aligned with the butting edges of the circuit boards. A clamp 21 straggles over the vertical walls of the butting brackets 24 to pull the two circuit boards 101, 102 together. The brackets also prevent the two circuit boards to dangle with respect to each other.

Figure 3:
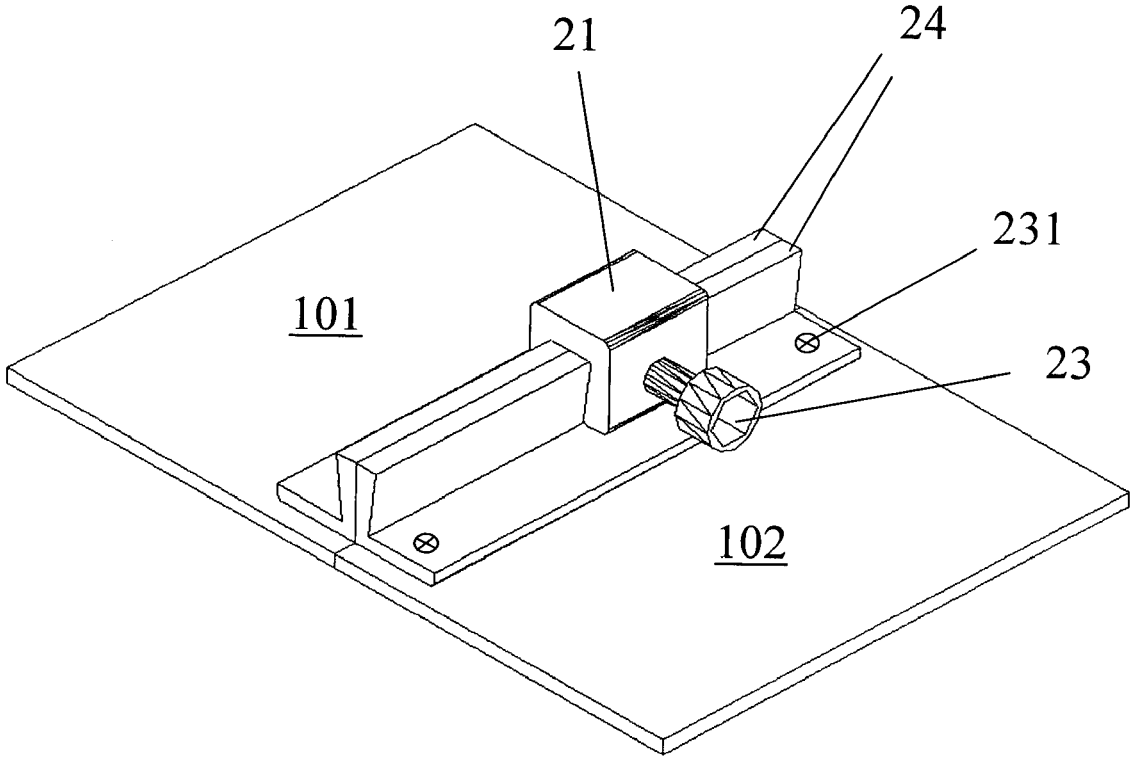
FIG. 3 shows the clamp for pressing two LED circuit boards together.

FIG. 3 shows a second embodiment of the present invention. A set screw 23 is inserted on one jaw of the clamp 21. By tightening the set screw 23, the clamp can exert greater pressure to butt the two circuit boards 101, 102 together. Otherwise, the same reference numerals correspond to the same functional parts as in FIG. 2.

Figure 4:
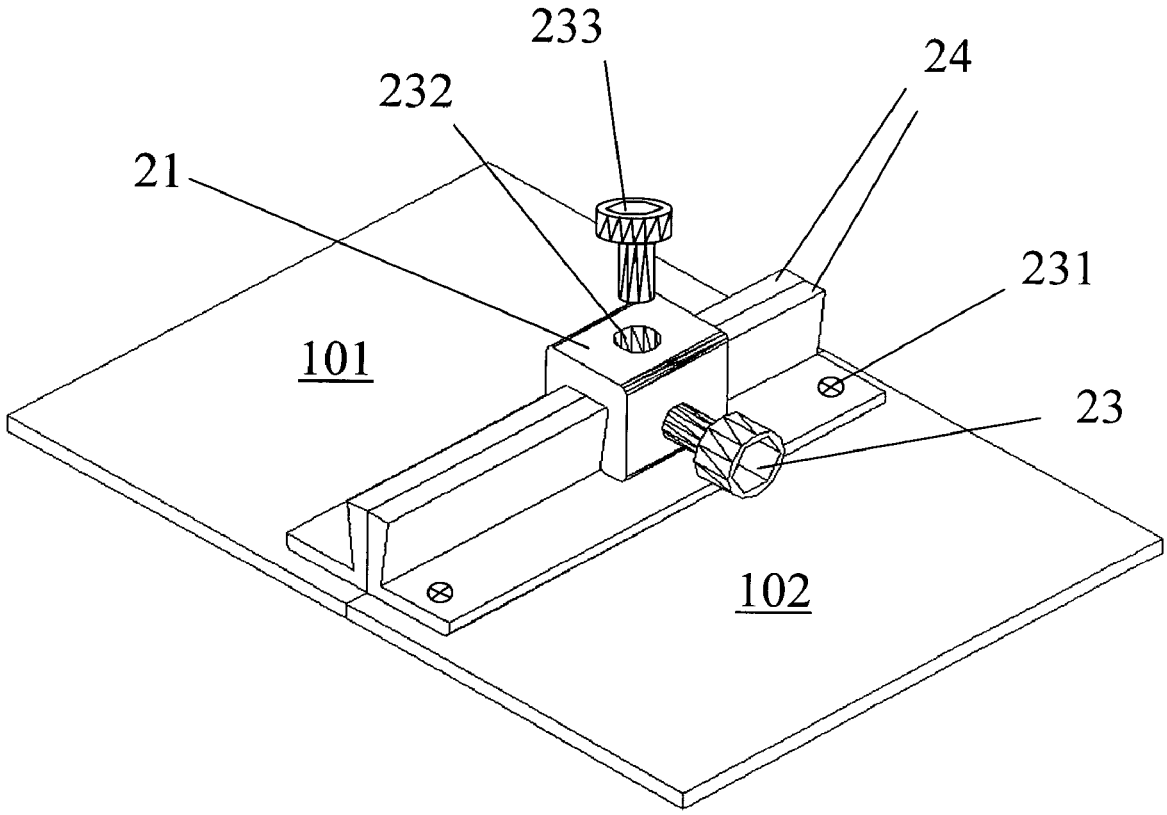
FIG. 4 shows a 2-dimensional clamp to tighten to circuit boards in two dimensions.

FIG. 4 shows a third embodiment of the present invention. In addition to the horizontal set screw 23, an additional vertical set screw 233 is inserted on top of the clamp 21. The vertical set screw 233 exerts vertical pressure on the clamp, and prevents any misalignment of the two circuit boards 101, 102 in the vertical direction. Otherwise, the same reference numerals correspond to the same functional parts as in FIG. 2.

Figure 5:
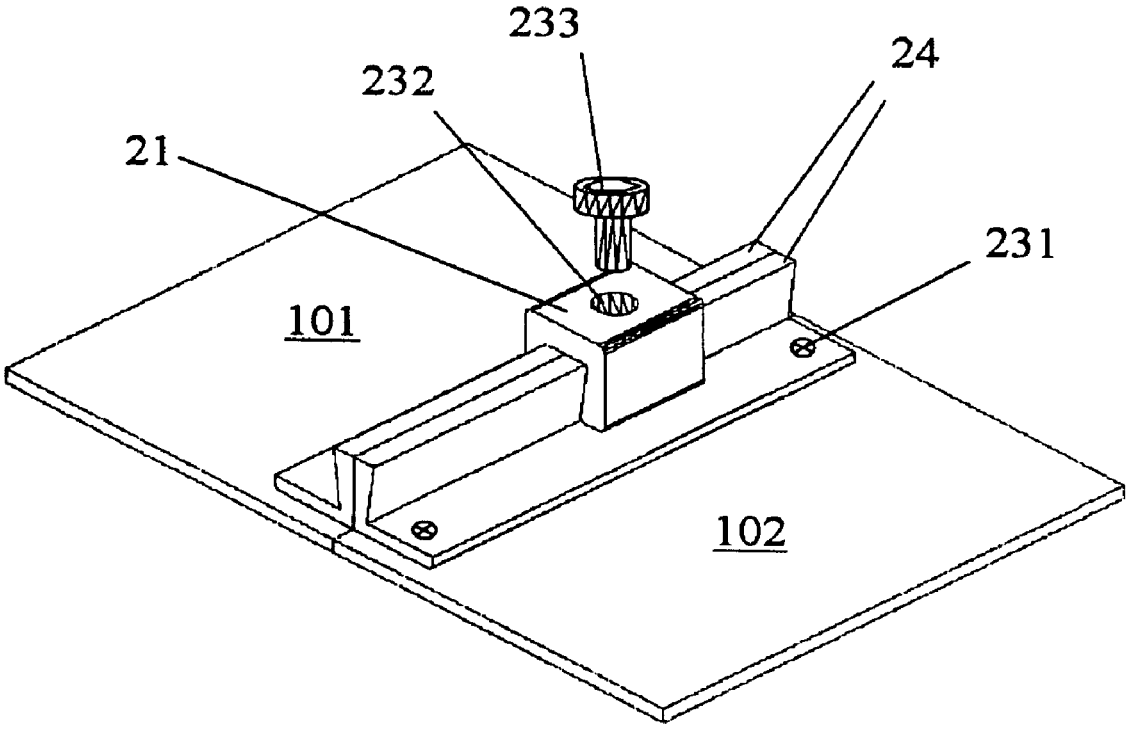
FIG. 5 shows a vertical set screw to press the clamp in the vertical direction.

FIG. 5 shows a fourth embodiment of the present invention A set screw 233 is inserted on top of the clamp 21 described in FIG. 2. The vertical set screw 233 exerts vertical pressure on the clamp 21, and presents any misalignment of the two circuit boards 101, 102 in the vertical direction. Otherwise, the same reference numerals correspond to the same functional part as in FIG. 2.

While the preferred embodiments of the invention have been described, it will be obvious to those skilled in the art that various modifications may be made without departing from the spirit of the present invention. Such modifications are all within the scope of this invention.

The invention claimed is:

1. A light emitting diode (LED) display panel, comprising:

more than one circuit board, butting against each other, each mounted with a LED matrix array on the top side of said circuit board;

an L-shaped bracket mounted at the bottom side of each said circuit board and aligned with a butting edge of said circuit board, having a vertical wall facing another said vertical wall of an adjacent circuit board, and a horizontal bottom attached to the bottom side of the circuit board by screws;

a clamp straggling over two butting said vertical walls of adjacent said brackets to tighten the contact between adjacent said circuit boards;

a set screw inserted at the vertical jaw of said clamp to tighten the two adjacent circuit boards butting against each other; and a second set screw on top of the clamp to align the adjacent said circuit boards vertically.

2. A light emitting diode (LED) display panel, comprising:

more than one circuit board, butting against each other, each mounted with a LED matrix array on the top side of said circuit board;

an L-shaped bracket mounted at the bottom side of each said circuit board and aligned with a butting edge of said circuit board, having a vertical wall facing another said vertical wall of an adjacent circuit board, and a horizontal bottom attached to the bottom side of the circuit board by screws;

a clamp straggling over two butting said vertical walls of adjacent said brackets to tighten the contact between adjacent said circuit boards; and a set screw on top of the clamp to align the adjacent said circuit boards vertically.

* * * * *